US009785163B2

(12) United States Patent
Takano

(10) Patent No.: US 9,785,163 B2
(45) Date of Patent: Oct. 10, 2017

(54) REGULATOR

(71) Applicant: Yoichi Takano, Tokyo (JP)

(72) Inventor: Yoichi Takano, Tokyo (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/352,791

(22) Filed: Nov. 16, 2016

(65) Prior Publication Data

US 2017/0199535 A1 Jul. 13, 2017

(30) Foreign Application Priority Data

Jan. 8, 2016 (JP) ..... 2016-002342

(51) Int. Cl.
*G05F 1/573* (2006.01)
*G05F 1/56* (2006.01)

(52) U.S. Cl.
CPC ..... *G05F 1/573* (2013.01); *G05F 1/56* (2013.01)

(58) Field of Classification Search
CPC . G05F 1/56; G05F 1/575; G05F 1/465; G05F 1/468; G05F 1/462; G05F 1/562; G05F 1/565; G05F 1/567; G05F 1/569; G05F 1/571; G05F 1/573; G05F 1/5735
USPC ..... 323/273–281, 303
See application file for complete search history.

(56) References Cited

U.S. PATENT DOCUMENTS 9,372,489 B2 6/2016 Kobayashi et al.
2014/0253070 A1* 9/2014 Sakaguchi ..... G05F 1/573 323/273
2015/0212530 A1* 7/2015 Forejtek ..... G05F 1/575 323/280

FOREIGN PATENT DOCUMENTS

JP H06-138961 5/1994
JP H10-301642 11/1998
JP 2015-082196 4/2015

OTHER PUBLICATIONS

Nakashita Takao, Voltage regulator,Patent of Japan, English translation, Publication No. 10-301642, Pbulication date Nov. 13, 1998.*

* cited by examiner

*Primary Examiner* — Nguyen Tran
(74) *Attorney, Agent, or Firm* — IPUSA, PLLC

(57) ABSTRACT

A regulator 100 is provided. The regulator 100 includes an output transistor M1 controlled by an output of an error amplifier circuit 104; a first MOS transistor M2 having a gate that is connected to a first terminal; a second MOS transistor M3, having a source that is connected to a second terminal 102, having a gate and a drain that are connected to a drain of the first MOS transistor M2; and a third MOS transistor M4, having a drain that is connected to a drain of the output transistor M1, having a gate that is connected to a gate of the second MOS transistor M3, and having a source that is connected to the second terminal 102. An output of the error amplifier circuit 104 is connected to a source of the first MOS transistor M2 via a signal processing circuit 110 or 210.

1 Claim, 3 Drawing Sheets

REGULATOR

BACKGROUND OF THE INVENTION

1. Field of the Invention

The present invention relates to a regulator.

2. Description of the Related Art

In a voltage regulator (hereinafter, referred to as "regulator"), there is a case where, due to an influence of an off-leak current flowing in an output transistor, an output voltage of the regulator increases when an output current is low and temperature is high. A regulator is known in which a circuit is added for providing the same level of current as the off-leak current of the output transistor in order to prevent the increase of the output voltage (e.g., refer to PLT 1).

FIG. 5 is a drawing illustrating an example configuration of a conventional regulator described in PLT 1. In FIG. 5, an off-leak current I proportional to an off-leak current Iout of an output transistor M501 flows in a transistor M502 according to a size ratio between the output transistor M501 and the transistor M502. For example, when a gate length of the output transistor M501 is L1, a gate width is W1, a gate length of the transistor M502 is L2, and a gate width is W2, a ratio between I and Iout is I/Iout=(W2/L2)/(W1/L1).

A current according to the ratio flows in the transistor M502. Further, the same amount of current flows in a transistor M503 as in the transistor M502, and proportional currents flow in the transistor 503 and a transistor 504 according to a ratio of transistor sizes between the transistors M503 and M504. In the above arrangement, by drawing the same level of a current as the off-leak current of the output transistor M501 into the transistor M504, it is possible to suppress an output voltage increase due to the off-leak current of the output transistor.

It should be noted that, in the above arrangement, a current flows in the transistor M504 according to the leak current of the transistor M502 regardless the level of the output current of the regulator when temperature is high. Therefore, when load of the regulator is heavy (when an output current is high), a wasteful current is consumed by a circuit for compensating an off-leak current of the output transistor M501.

FIG. 6 is a drawing illustrating another example configuration of a conventional regulator described in PLT 1. In FIG. 6, in the case where load of a regulator is light, an error amplifier circuit 502 operates in a direction for turning off the output transistor M501. At this time, according to the same operation of the error amplifier circuit 502, the transistor M505 is controlled in a direction for being turned off. With the above operations, an input of the inverter circuit 601 turns to a low level because it is drawn to a low level by a constant current circuit 602. As a result, the inverter circuit 601 turns on the transistor M506, and circuits (M502, M503, and M504) for compensating the off-leak current of the output transistor M501 operate.

On the other hand, when load of the regulator is heavy, the transistor M505 is turned on, the input of the inverter circuit 601 turns to a high level, and the transistor M506 is turned off. Because the transistor M506 is turned off, the off-leak current of the transistor M502 does not flow, and the circuits for compensating the off-leak current of the output transistor do not operate.

With the above arrangement, when load of the regulator is heavy (when an output current is high), it is possible to reduce current consumption by the circuits for compensating the off-leak current of the output transistor M501.

CITATION LIST

Patent Literature

[PLT 1] Japanese Laid-Open Patent Application No. H10-301642

SUMMARY OF THE INVENTION

Technical Problem

According to a regulator described in PLT 1, it is possible to suppress an increase of an output voltage due to an off-leak current at the time of high temperature and light load. However, because of down-sizing, cost-reduction, etc., of an apparatus or the like on which a regulator is mounted, a regulator with fewer elements has become desired which regulator is capable of suppressing an increase of an output voltage due to an off-leak current at the time of light load and high temperature.

In view of the above, the present invention has been made. It is an object of the present invention to provide a regulator, with elements fewer than the conventional regulator, which is capable of suppressing an increase of an output voltage due to an off-leak current at the time of light load and high temperature.

Solution to Problem

A regulator (100) is provided. The regulator (100) includes an output terminal (107) configured to output an output voltage of the regulator (100); a reference voltage circuit (103) connected between a first terminal (101) and a second terminal (102) of the regulator (100); an error amplifier circuit (104) with two inputs, one of the inputs being connected to an output of the reference voltage circuit (103); an output transistor (M1) of a first conductivity type (P channel) configured to output the output voltage; voltage dividing resistors (R1, R2), connected to the output transistor (M1) in series between the first terminal (101) and the second terminal (102), configured to divide the output voltage of the output transistor (M1), the divided voltage being connected to the other input of the error amplifier circuit (104); a first MOS transistor (M2) having a gate that is connected to the first terminal (101); a second MOS transistor (M3) of a second conductivity type (N channel) connected between a drain of the first MOS transistor (M2) and the second terminal (102), having a source that is connected to the second terminal (102) and having a gate and a drain that are connected to each other; a third MOS transistor (M4) of the second conductivity type (N channel), having a drain that is connected to a drain of the output transistor (M1), having a gate that is connected to the gate of the second MOS transistor (M3), and having a source that is connected to the second terminal (102); and a signal processing circuit (110 or 210). An output of the error amplifier circuit (104) is connected to the source of the first MOS transistor (M2) via the signal processing circuit (110 or 210).

Preferably, the signal processing circuit (110) includes a fourth MOS transistor (M5) of a first conductivity type, having a gate that is connected to the output of the error amplifier circuit (104) and having a source that is connected to the first terminal (101); a current source (106) connected between a drain of the fourth MOS transistor (M5) and the second terminal (102); and an inverter (105) with an input and an output. The drain of the fourth MOS transistor (M5)

is connected to the input of the inverter (105) and the output of the inverter (105) is connected to the source of the first MOS transistor (M2).

Preferably, the signal processing circuit (210) includes a fourth MOS transistor (M5) of a first conductivity type (P channel), having a gate that is connected to an output of the error amplifier circuit (104) and having a source that is connected to the first terminal (101); a current source (106) connected between a drain of the fourth MOS transistor (M5) and the second terminal (102); and a comparator (211) with two inputs. The drain of the fourth MOS transistor (M5) is connected to one of the inputs of the comparator (211) and the other input of the comparator (211) is connected to a reference voltage (212), and an output of the comparator (211) is connected to the source of the first MOS transistor (M2).

Further, a regulator (100) according to another embodiment is provided. The regulator (100) includes an output terminal (107) configured to output an output voltage of the regulator (100); a reference voltage circuit (103) connected between a first terminal (101) and a second terminal (102) of the regulator (100); an error amplifier circuit (104) with two inputs, one of the inputs being connected to an output of the reference voltage circuit (103); an output transistor (M1) of a first conductivity type (P channel) configured to be controlled by an output of the error amplifier circuit (104) and output the output voltage; voltage dividing resistors (R1, R2), connected to the output transistor (M1) in series between the first terminal (101) and the second terminal (102), configured to divide the output voltage of the output transistor (M1), the divided voltage being connected to the other input of the error amplifier circuit (104); a first MOS transistor (M2) having a gate and a source that are connected to each other; a second MOS transistor (M3) of a second conductivity type (N channel) connected between a drain of the first MOS transistor (M2) and the second terminal (102), having a source that is connected to the second terminal (102) and having a gate and a drain that are connected to each other; a third MOS transistor (M4) of the second conductivity type (N channel), having a drain that is connected to a drain of the output transistor (M1), having a gate that is connected to a gate of the second MOS transistor (M3), and having a source that is connected to the second terminal (102); and a signal processing circuit (110 or 210). The output of the error amplifier circuit (104) is connected to the gate and the source of the first MOS transistor (M2) via the signal processing circuit (110 or 210).

Preferably, the signal processing circuit (110) includes a fourth MOS transistor (M5) of a first conductivity type (P channel), having a gate that is connected to the output of the error amplifier circuit (104) and having a source that is connected to the first terminal (101); a current source (106) connected between a drain of the fourth MOS transistor (M5) and the second terminal (102); and an inverter (105) with an input and an output. The drain of the fourth MOS transistor (M5) is connected to the input of the inverter (105) and the output of the inverter (105) is connected to the gate and the source of the first MOS transistor (M2).

Preferably, the signal processing circuit (210) includes a fourth MOS transistor (M5) of a first conductivity type, having a gate that is connected to the output of the error amplifier circuit (104) and having a source that is connected to the first terminal (101); a current source (106) connected between a drain of the fourth MOS transistor (M5) and the second terminal (102); and a comparator (211) with two inputs. The drain of the fourth MOS transistor (M5) is connected to one of the inputs of the comparator (211) and the other input of the comparator (211) is connected to a reference voltage (212), and an output of the comparator (211) is connected to the gate and the source of the first MOS transistor (M2).

It should be noted that reference codes in the above parentheses are included for the sake of easy understanding, which codes are merely examples. An embodiment is not limited to the one illustrated in the drawings.

Advantageous Effects of Invention

According to an embodiment, a regulator is provided. It is possible for the regulator with a number of elements fewer than the conventional regulator to suppress an increase of an output voltage due to an off-leak current at the time of light load and high temperature by using a first MOS transistor as an off-leak current generation source at the time of high temperature and also as a switching element.

DETAILED DESCRIPTION OF THE PREFERRED EMBODIMENTS

In the following, embodiments of the present invention will be described referring to the accompanied drawings.

First Embodiment

Figure 1:
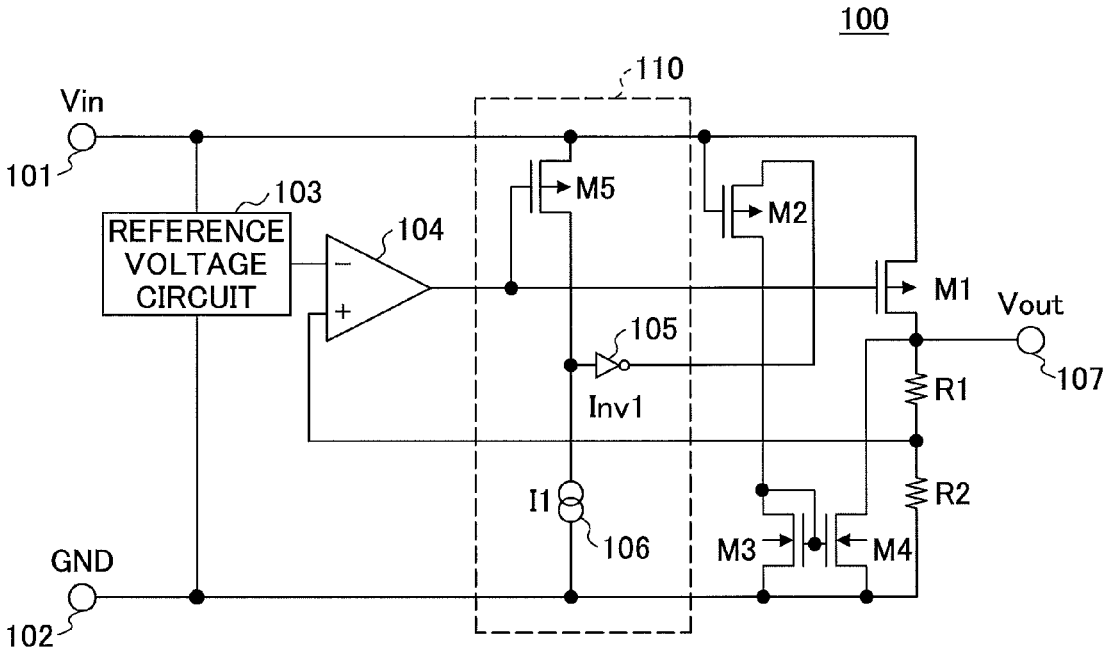
FIG. 1 is a configuration diagram of a regulator according to a first embodiment.

FIG. 1 is a configuration diagram of a regulator 100 according to a first embodiment.

In FIG. 1, the regulator 100 includes a first terminal 101 to which a power supply voltage Vin is input, a second terminal 102 which is connected to a ground voltage GND, and an output terminal 107 which outputs an output voltage Vout. The regulator 100 is a constant voltage circuit with which the power supply voltage Vin input to the first terminal 101 is stepped down to a predetermined output voltage Vout, and the output voltage Vout is output.

The regulator illustrated in FIG. 1 includes a reference voltage circuit 103, an error amplifier circuit 104, an output transistor M1, voltage dividing resistors R1 and R2, a first MOS transistor M2, a second MOS transistor M3, a third MOS transistor M4, a signal processing circuit 110, etc.

The reference voltage circuit 103 is connected between the first terminal 101 and the second terminal 102, and outputs a reference voltage (hereinafter, referred to as "Vref") according to the output voltage Vout.

One (−) of two inputs of the error amplifier circuit 104 is connected to the output Vref of the reference voltage circuit 103, and the other input (+) is connected to a voltage obtained by dividing the output voltage Vout by using voltage dividing resistors R1 and R2. The error amplifier circuit 104 is a differential amplifier which amplifies and outputs a difference between the Vref output by the reference voltage circuit 103 and the divided voltage output by the voltage dividing resistors R1 and R2.

The output transistor M1 is a transistor of a P channel type (first conductivity type) (e.g., a MOS-FET) which is controlled by an output of the error amplifier circuit 104, and outputs an output voltage Vout. The output transistor M1, having a source that is connected to the first terminal 101 and having a drain that is connected to the output terminal 107, is connected to the second terminal 102 via the voltage dividing resistors R1 and R2.

The voltage dividing resistors R1 and R2 are connected to the output transistor M1 in series between the first terminal 101 and the second terminal 102. The voltage dividing resistors R1 and R2 divide an output voltage of the output transistor M1 and the divided voltage is output to the input (+) of the error amplifier circuit 104. For example, when resistance values of the voltage dividing resistors R1 and R2 are r1 and r2, respectively, and the output voltage is Vout, the divided voltage (hereinafter, referred to as "Vp") is obtained by Vp=Vout*r2/(r1+r2).

The error amplifier circuit 104 compares Vref input from the reference voltage circuit 103 with Vp input from the voltage dividing resistors R1 and R2, and controls the output transistor M1 to cause Vref to be always the same as Vp.

In the above arrangement, in order to increase current capacity of the output transistor M1, an element with a large area and fine patterning is used for the output transistor M1. Further, in the output transistor M1, a leak current is generated at a junction, and a greater leak current is generated at the time of high temperature.

Further, there is a case where current consumption is low due to reduced energy consumption in a mobile apparatus such as a wearable terminal on which the regulator 100 is mounted, and resistance values of the voltage dividing resistors R1 and R2 used for reducing the current consumption of the regulator 100 are set high.

As a result, in the regulator 100, there is a case in which the current flowing in the voltage dividing resistors R1 and R2 increases due to the leak current of the output transistor M1 at the time of light load and high temperature, and the output voltage increases higher than the set value.

In order to suppress an increase of the output voltage due to the leak current at the time of light load and high temperature, a regulator according to an embodiment of the present invention includes the followings.

The first MOS transistor M2 is a MOS transistor of a P channel type (first conductivity type). The gate of the first MOS transistor M2 is connected to the first terminal 101, and the source of the first MOS transistor M2 is connected to the output of the signal processing circuit 110.

For example, it is assumed that the output from the signal processing circuit 110 is a high level (e.g., a voltage as high as the power supply voltage Vin). In this case, in the first MOS transistor M2, a leak current I proportional to the leak current Iout of the output transistor M1 flows according to a size ratio between the output transistor M1 and the first MOS transistor M2. For example, in the case where the size ratio between the output transistor M1 and the first MOS transistor M2 is 100 to 1, the leak current I proportional to the leak current Iout of the output transistor M1 (I=Iout/100) flows in the first MOS transistor M2. On the other hand, in the case where the output from the signal processing circuit 110 is a low level (e.g., a voltage equal to the ground potential GND), no leak current flows in the first MOS transistor M2.

The second MOS transistor M3 is a MOS transistor of N channel type (second conductivity type) connected between the drain of the first MOS transistor M2 and the second terminal 102. The source of the second MOS transistor M3 is connected to the second terminal 102, and the gate and the drain of the second MOS transistor M3 are connected to each other. The leak current I of the first MOS transistor M2 flows in the second MOS transistor M3.

The third MOS transistor M4 is a MOS transistor of a N channel type, having a drain that is connected to the drain of the output transistor M1, having a gate that is connected to the gate of the second MOS transistor M3, and having a source that is connected to the second terminal 102. In the third MOS transistor M4, a current i proportional to the current I flowing in the second MOS transistor M3 flows according to a ratio between the second MOS transistor M3 and the third MOS transistor M4.

For example, in the case where the output from the signal processing circuit 110 is a high level and the size ratio between the second MOS transistor M3 and the third MOS transistor M4 is 1 to 100, the current i (i=100*I=Iout) flows in the third MOS transistor M4. In this case, a current equal to the leak current Iout of the output transistor M1 flows in the third MOS transistor M4. On the other hand, in the case where the output from the signal processing circuit 110 is a low level, no current flows in the third MOS transistor M4.

The signal processing circuit 110 is connected to the first terminal 101 and the second terminal 102, and detects that the output current Iout of the output transistor M1 has decreased lower than a predetermined value based on an input output from the error amplifier circuit 104. Further, when the signal processing circuit 110 detects that the output current Iout of the output transistor M1 has decreased lower than the predetermined value, a high level (e.g., a voltage equal to the power supply voltage Vin) is output to the source of the first MOS transistor M2.

In FIG. 1, the signal processing circuit 110 according to the first embodiment includes the fourth MOS transistor M5, the current source 106 and the inverter 105.

The fourth MOS transistor M5 is a MOS transistor of P channel type (first conductivity type). The gate of the fourth MOS transistor M5 is connected to the error amplifier circuit 104 and the source of the fourth MOS transistor M5 is connected to the first terminal 101.

The current source 106 is connected between the fourth MOS transistor M5 and the second terminal 102, and is a constant current circuit which provides a predetermined current.

The inverter 105 is an inverting circuit, having an input that is connected to the drain of the fourth MOS transistor M5 and having an output that is connected to the source of the first MOS transistor M2. In the case where, for example, the power supply voltage Vin is provided and the input level is low, the inverter 105 outputs a high level (a voltage equal to the power supply voltage Vin) signal, and in the case where the input level is high, the inverter 105 outputs a low level (a voltage equal to the ground voltage GND) signal.

In the signal processing circuit 110, when the output current Iout of the output transistor M1 decreases due to an output of the error amplifier circuit 104, a current flowing in the fourth MOS transistor M5 also decreases proportionally to the output current Iout. Further, a value of a current flowing in the current source 106 is preset in such a way that the input level of the inverter 105 turns to a low level when the output current Iout flowing in the output transistor M1 is less than a predetermined value and a current flowing in the fourth MOS transistor M5 is equal to or less than a threshold value.

With the above arrangement, when the signal processing circuit 110 detects that the output current of the output transistor M1 is less than the predetermined value (the load is light), the signal processing circuit 110 outputs a signal of a voltage equal to the first terminal 101 to the source of the first MOS transistor M2. With the above arrangement, in the first MOS transistor M2 and the second MOS transistor M3, a leak current I according to the size ratio (e.g., 100 to 1) between the output transistor M1 and the first MOS transistor M2 (e.g., I=Iout/100) flows. Further, in the third MOS transistor M4, a current i according to the size ratio (e.g., 100 to 1) between the second MOS transistor M3 and the third MOS transistor M4 (e.g., i=100*I=Iout) flows.

Therefore, in the regulator 100, when load is light, a current i equal to the leak current Iout of the output transistor M1 is drawn into the third MOS transistor M4, and thus, an increase of the output voltage Vout due to the leak current of the output transistor M1 can be suppressed.

On the other hand, when the output current of the output transistor M1 is equal to or greater than the predetermined value (the load is heavy), the signal processing circuit 110 outputs a signal of a voltage equal to the second terminal 102 to the source of the first MOS transistor M2. With the above arrangement, in the first MOS transistor M2 and the second MOS transistor M3, the leak current I does not flow.

Therefore, in the regulator 100, when the load is heavy, it is possible to reduce a current consumed by circuits for compensating the leak current of the output transistor M1 (the first MOS transistor M2, the second MOS transistor M3, and the third MOS transistor M4).

Figure 6:
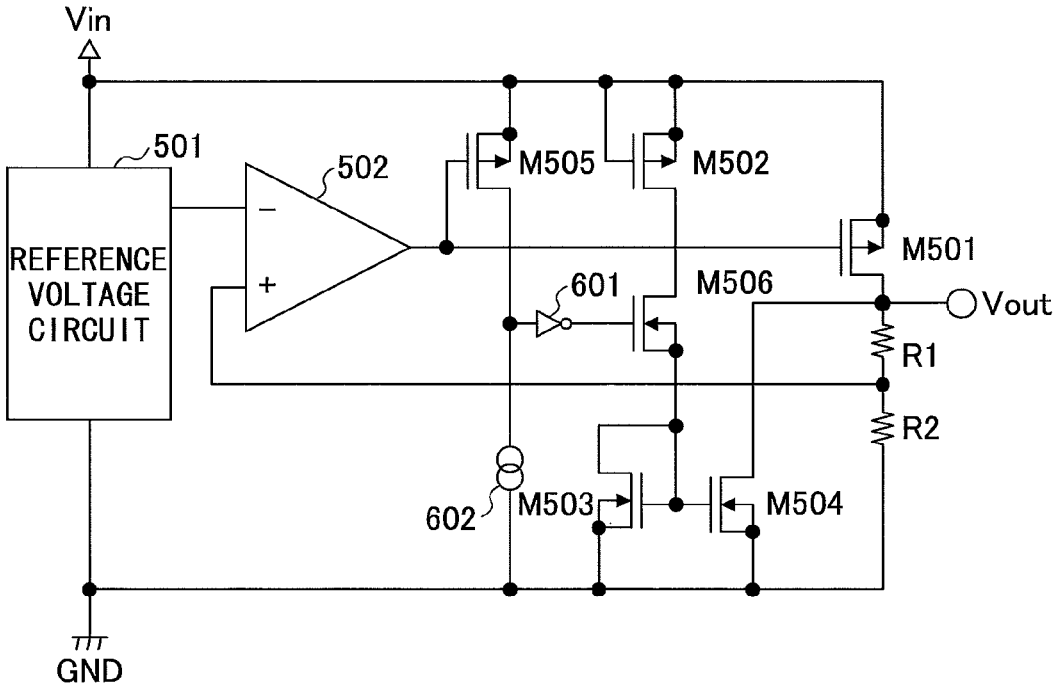
FIG. 6 is a drawing illustrating another example of a configuration of a conventional regulator.

As described above, according to an embodiment, a regulator 100 with a number of elements fewer than the conventional regulator (e.g., a regulator illustrated in FIG. 6) is provided. It is possible for the regulator 100 to suppress an increase of the output voltage due to the leak current at the time of light load and high temperature.

Second Embodiment

In a second embodiment, another example of a signal processing circuit 110 of a regulator 100 according to the first embodiment illustrated in FIG. 1 will be described.

Figure 2:
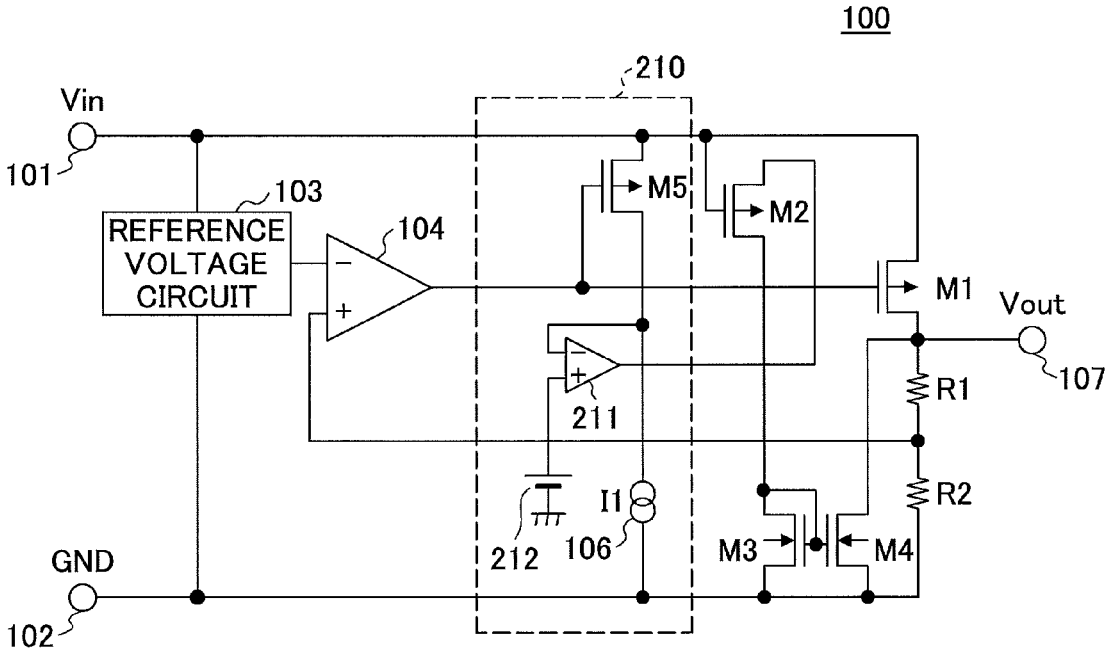
FIG. 2 is a configuration diagram of a regulator according to a second embodiment.

FIG. 2 is a configuration diagram of a regulator 100 according to the second embodiment. In FIG. 2, in the regulator 100, a configuration of the signal processing circuit 210 is different from the configuration of the signal processing circuit 110 according to the first embodiment illustrated in FIG. 1. It should be noted that, other than the configuration of the signal processing circuit 210, the regulator 100 is the same as the regulator according to the first embodiment illustrated in FIG. 1, and thus, the difference will be mainly described.

The signal processing circuit 210 is connected to the first terminal 101 and the second terminal 102, and detects that the output current Iout of the output transistor M1 has decreased lower than a predetermined value based on an input output from the error amplifier circuit 104. Further, when the signal processing circuit 210 detects that the output current Iout of the output transistor M1 has decreased lower than the predetermined value, a high level (e.g., a voltage equal to the power supply voltage Vin) is output to the source of the first MOS transistor M2.

In FIG. 2, the signal processing circuit 210 according to the second embodiment includes the fourth MOS transistor M5, the current source 106 and the comparator 211.

It should be noted that the configuration of the fourth MOS transistor M5 and the current source 106 is the same as the configuration according to the first embodiment illustrated in FIG. 1.

The comparator 211 has two inputs including a negative (−) input and a positive (+) input. The negative input is connected to the drain of the fourth MOS transistor M5 and the positive input is connected to the reference voltage 212. When, for example, the power supply voltage Vin is provided and a voltage of the negative input is greater than a voltage of the positive input, the comparator 211 outputs a low level (a voltage equal to the ground voltage GND) signal, and when the voltage of the negative input is less than the voltage of the positive input, the inverter 105 outputs a high level (a voltage equal to the power supply voltage Vin) signal.

In an example of FIG. 2, the comparator 211 outputs a high level (a voltage equal to the power supply voltage Vin) signal when a voltage of the drain of the fourth MOS transistor M5 connected to the negative input is less than the reference voltage 212 (e.g., Vin/2). Further, the comparator 211 outputs a low level (a voltage equal to the ground voltage GND) signal when the voltage of the drain of the fourth MOS transistor M5 is greater than the reference voltage 212 (e.g., Vin/2).

In FIG. 2, when the output current Iout of the output transistor M1 decreases due to an output of the error amplifier circuit 104, a current flowing in the fourth MOS transistor M5 also decreases proportionally to the output current Iout.

Further, a value of a current flowing in the current source 106 is preset in such a way that a voltage of the drain of the fourth MOS transistor M5 turns to a low level when the output current Iout flowing in the output transistor M1 is less than a predetermined value and a current flowing in the fourth MOS transistor M5 is equal to or less than a threshold value.

With the above arrangement, the signal processing circuit 210 according to an embodiment operates in the similar way as the signal processing circuit 110 according to the first embodiment. In other words, when the signal processing circuit 210 detects that the output current of the output transistor M1 is less than the predetermined value (the load is light), the signal processing circuit 210 outputs a signal of a voltage equal to the first terminal 101 to the source of the first MOS transistor M2. Further, when the output current of the output transistor M1 is equal to or greater than the predetermined value (the load is heavy), the signal processing circuit 210 outputs a signal of a voltage equal to the second terminal 102 to the source of the first MOS transistor M2.

It should be noted that the signal processing circuit 210 according to an embodiment controls the first MOS transistor M2 by using the comparator 211, and thus, it is possible for the signal processing circuit 210 to accurately set a threshold value of ON/OFF of the first MOS transistor M2.

As described above, according to an embodiment, similar to the first embodiment, a regulator 100 with a number of elements fewer than the conventional regulator is provided. It is possible for the regulator 100 to suppress an increase of the output voltage due to the leak current at the time of light load and high temperature. Further, according to the regulator 100, it is possible to accurately set a threshold value of ON/OFF of the first MOS transistor M2 by using the comparator 211 and the reference voltage 212.

Third Embodiment

In a third embodiment, yet another example of a regulator 100 according to the first embodiment illustrated in FIG. 1 will be described.

Figure 3:
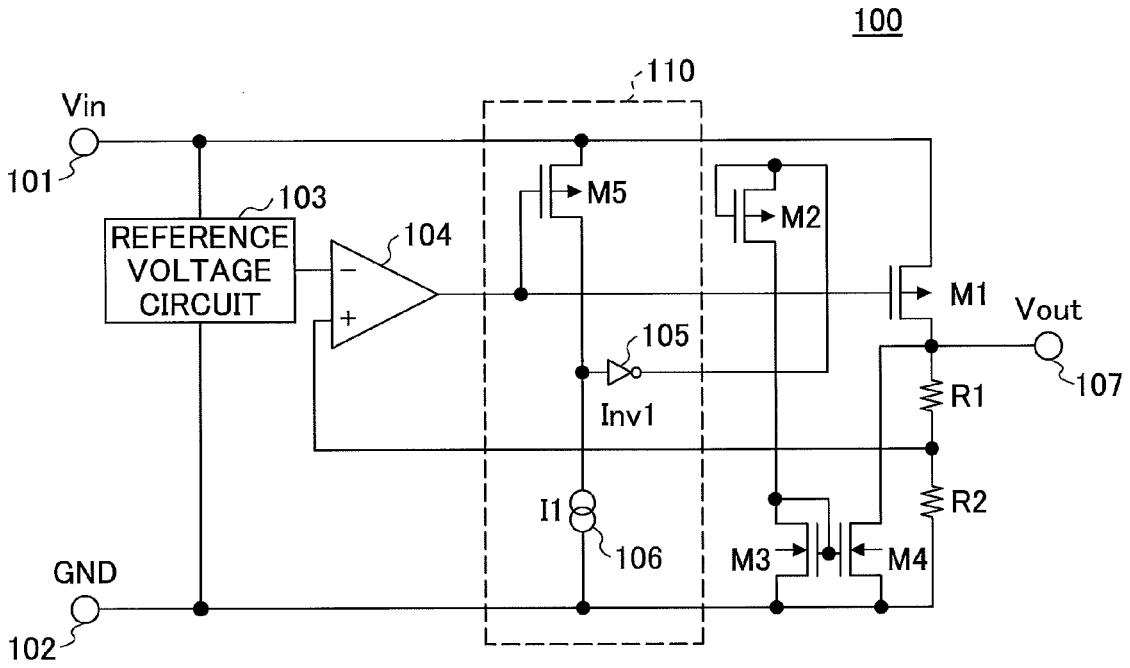
FIG. 3 is a configuration diagram of a regulator according to a third embodiment.

FIG. 3 is a configuration diagram of a regulator 100 according to the third embodiment. In FIG. 3, in the regulator 100 according to the third embodiment, the gate of the first MOS transistor M2 is connected to the source of the first MOS transistor M2 and the output of the inverter 105. It should be noted that, other than the above, the configuration is the same as the regulator 100 according to the first embodiment illustrated in FIG. 1.

Similar to the first embodiment, when the signal processing circuit 110 detects that the output current of the output transistor M1 is less than the predetermined value, the signal processing circuit 110 outputs a signal of a voltage equal to the first terminal 101 (Vin) to the gate and the source of the first MOS transistor M2.

At this time, in the first MOS transistor M2 and the second MOS transistor M3, similar to the first embodiment, the leak current I according to the size ratio between the output transistor M1 and the first MOS transistor M2 (e.g., I=Iout/100) flows. Further, in the third MOS transistor M4, the current i according to the size ratio (e.g., 100 to 1) between the second MOS transistor M3 and the third MOS transistor M4 (e.g., i=100*I=Iout) flows.

Therefore, in the regulator 100, when load is light, the current i equal to the leak current Iout of the output transistor M1 is drawn into the third MOS transistor M4, and thus, an increase of the output voltage Vout due to the leak current of the output transistor M1 can be suppressed.

On the other hand, when the output current of the output transistor M1 is equal to or greater than the predetermined value (the load is heavy), the signal processing circuit 110 outputs a signal of a voltage equal to the second terminal 102 to the source of the first MOS transistor M2. With the above arrangement, in the first MOS transistor M2 and the second MOS transistor M3, the leak current I does not flow.

Therefore, in the regulator 100, when the load is heavy, it is possible to reduce a current consumed by circuits for compensating the leak current of the output transistor M1 (the first MOS transistor M2, the second MOS transistor M3, and the third MOS transistor M4).

As described above, according to an embodiment, a regulator 100 with a number of elements fewer than the conventional regulator (e.g., a regulator illustrated in FIG. 6) is provided. It is possible for the regulator 100 to suppress an increase of the output voltage due to the leak current at the time of light load and high temperature. Further, according to the regulator 100, it is not necessary to connect the gate of the first MOS transistor M2 to the first terminal 101, and thus, wiring between elements is easy.

Fourth Embodiment

In a fourth embodiment, yet another example of a regulator 100 according to the second embodiment illustrated in FIG. 2 will be described.

Figure 4:
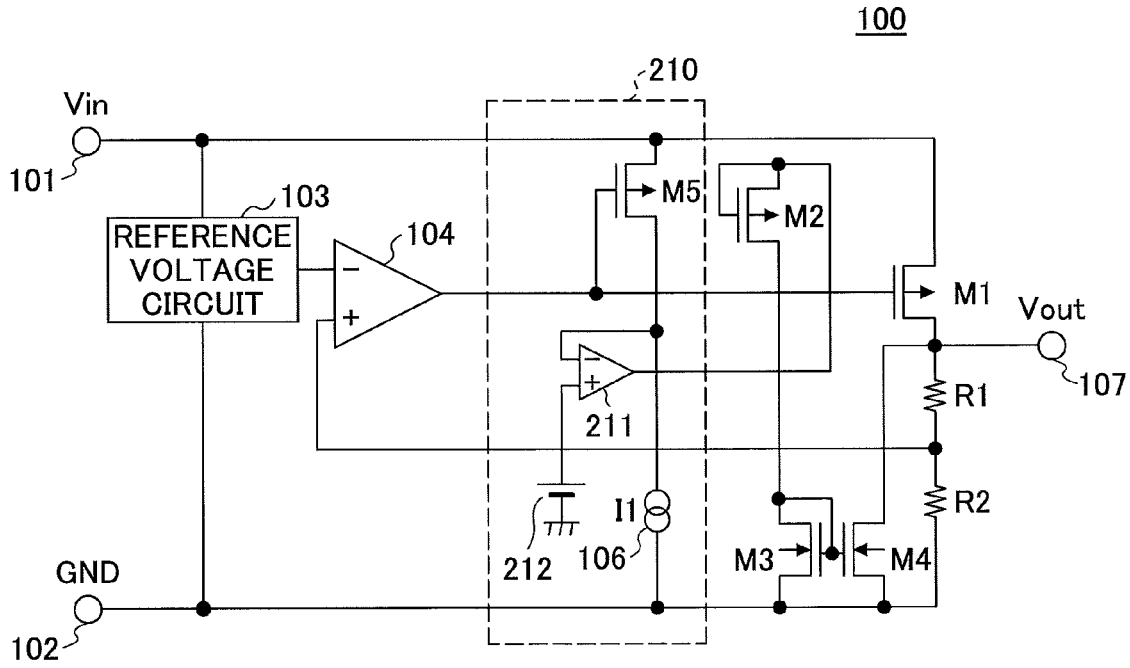
FIG. 4 is a configuration diagram of a regulator according to a fourth embodiment.
Figure 5:
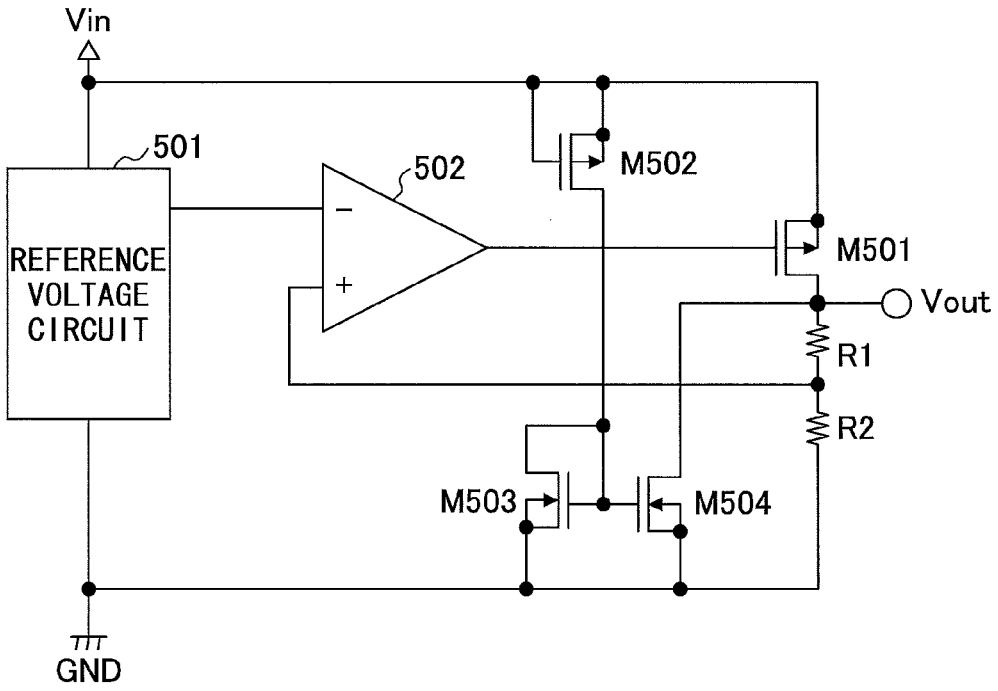
FIG. 5 is a drawing illustrating an example of a configuration of a conventional regulator.

FIG. 4 is a configuration diagram of a regulator 100 according to the fourth embodiment. In FIG. 4, in the regulator 100 according to the fourth embodiment, the gate of the first MOS transistor M2 is connected to the source of the first MOS transistor M2 and the output of the comparator 211. It should be noted that, other than the above, the configuration is the same as the regulator 100 according to the second embodiment illustrated in FIG. 2.

Similar to the second embodiment, when the signal processing circuit 210 detects that the output current of the output transistor M1 is less than the predetermined value, the signal processing circuit 110 outputs a signal of a voltage equal to the first terminal 101 (Vin) to the gate and the source of the first MOS transistor M2.

At this time, in the first MOS transistor M2 and the second MOS transistor M3, similar to the second embodiment, the leak current I according to the size ratio between the output transistor M1 and the first MOS transistor M2 (e.g., I=Iout/100) flows. Further, in the third MOS transistor M4, the current i according to the size ratio (e.g., 100 to 1) between the second MOS transistor M3 and the third MOS transistor M4 (e.g., i=100*I=Iout) flows.

Therefore, in the regulator 100, when load is light, the current i equal to the leak current Iout of the output transistor M1 is drawn into the third MOS transistor M4, and thus, an increase of the output voltage Vout due to the leak current of the output transistor M1 can be suppressed.

On the other hand, when the output current of the output transistor M1 is equal to or greater than the predetermined value (the load is heavy), the signal processing circuit 210 outputs a signal of a voltage equal to the second terminal 102 to the source of the first MOS transistor M2. With the above arrangement, in the first MOS transistor M2 and the second MOS transistor M3, the leak current I does not flow.

Therefore, in the regulator 100, when the load is heavy, it is possible to reduce a current consumed by circuits for compensating the leak current of the output transistor M1 (the first MOS transistor M2, the second MOS transistor M3, and the third MOS transistor M4).

As described above, according to an embodiment, a regulator 100 with a number of elements fewer than the conventional regulator is provided. It is possible for the regulator 100 to suppress an increase of the output voltage due to the leak current at the time of light load and high temperature. Further, according to the regulator 100, it is not necessary to connect the gate of the first MOS transistor M2 to the first terminal 101, and thus, wiring between elements is easy. Further, according to the regulator 100, it is possible to accurately set a threshold value of ON/OFF of the first MOS transistor M2 by using the comparator 211 and the reference voltage 212.

The present application is based on and claims the benefit of priority of Japanese Priority Application No. 2016-002342 filed on Jan. 8, 2016, the entire contents of which are hereby incorporated herein by reference.

What is claimed is:

1. A regulator comprising:

an output terminal configured to output an output voltage of the regulator;

a reference voltage circuit connected between a first terminal and a second terminal of the regulator;

an error amplifier circuit with two inputs, one of the inputs being connected to an output of the reference voltage circuit;

an output transistor of a first conductivity type configured to be controlled by an output of the error amplifier circuit and output the output voltage;

voltage dividing resistors, connected to the output transistor in series between the first terminal and the second terminal, configured to divide the output voltage of the output transistor, the divided voltage being output to the other input of the error amplifier circuit;

a first MOS transistor of the first conductive type, having a gate that is connected to the first terminal;

a second MOS transistor of a second conductive type connected between a drain of the first MOS transistor and the second terminal, having a source that is connected to the second terminal and having a gate and a drain that are connected to each other;

a third MOS transistor of the second conductive type, having a drain that is connected to a drain of the output transistor, having a gate that is connected to the gate of the second MOS transistor, and having a source that is connected to the second terminal; and a signal processing circuit, wherein the output of the error amplifier circuit is connected to a source of the first MOS transistor via the signal processing circuit, wherein the signal processing circuit includes a fourth MOS transistor of a first conductivity type, having a gate that is connected to the output of the error amplifier circuit and having a source that is connected to the first terminal, a current source connected between a drain of the fourth MOS transistor and the second terminal, and an inverter with an input and an output, wherein the drain of the fourth MOS transistor is connected to the input of the inverter, and wherein the output of the inverter is connected to the source of the first MOS transistor.

* * * * *